US010553324B2

(12) United States Patent
Shah et al.

(10) Patent No.: US 10,553,324 B2
(45) Date of Patent: Feb. 4, 2020

(54) PROCESS FOR THE REMOVAL OF $^{99}$TC FROM LIQUID INTERMEDIATE LEVEL WASTE OF SPENT FUEL REPROCESSING

(71) Applicant: Secretary, Department of Atomic Energy, Mumbai (IN)

(72) Inventors: Jayesh Gopaldas Shah, Mumbai (IN); Sumit Pahan, Mumbai (IN); Arvind Ananthanarayanan, Mumbai (IN)

(73) Assignee: Secretary, Department of Atomic Energy, Mumbai (IN)

( * ) Notice: Subject to any disclaimer, the term of this patent is extended or adjusted under 35 U.S.C. 154(b) by 0 days.

(21) Appl. No.: 16/076,523

(22) PCT Filed: May 9, 2017

(86) PCT No.: PCT/IN2017/050170
§ 371 (c)(1),
(2) Date: Aug. 8, 2018

(87) PCT Pub. No.: WO2018/207195
PCT Pub. Date: Nov. 15, 2018

(65) Prior Publication Data

US 2019/0348188 A1 Nov. 14, 2019

(51) Int. Cl.

| | |
|---|---|
| ***G21F 9/12*** | (2006.01) |
| ***C22C 38/00*** | (2006.01) |
| ***G21F 9/16*** | (2006.01) |
| ***G21F 9/30*** | (2006.01) |
| ***C22C 38/04*** | (2006.01) |
| ***C22C 38/02*** | (2006.01) |
| ***C22C 38/44*** | (2006.01) |

(52) U.S. Cl.
CPC ..... *G21F 9/12* (2013.01); *C22C 38/002* (2013.01); *C22C 38/02* (2013.01); *C22C 38/04* (2013.01); *C22C 38/44* (2013.01); *G21F 9/162* (2013.01); *G21F 9/305* (2013.01)

(58) Field of Classification Search
None
See application file for complete search history.

(56) References Cited

U.S. PATENT DOCUMENTS

| | | | |
|---|---|---|---|
| 6,133,498 | A | 10/2000 | Singh et al. |
| 2006/0235258 | A1 | 10/2006 | Wagh et al. |
| 2015/0348661 | A1 | 12/2015 | Wagh |

FOREIGN PATENT DOCUMENTS

| | | | |
|---|---|---|---|
| WO | 2004077454 | A2 | 9/2004 |

*Primary Examiner* — Melissa S Swain
(74) *Attorney, Agent, or Firm* — The Webb Law Firm

(57) ABSTRACT

Provided herein is a process for removal of $^{99}$Tc from liquid intermediate level waste (ILW) of spent fuel reprocessing including the steps of: adding $HNO_3$ to ILW till the pH is 2 to destroy the carbonates, transferring the ILW derived of carbonates to a tank containing mild steel wool (msw) for 4 to 48 hrs, subjecting the ILW and MS Wool to the step of separation, discharging the supernatant solution free of $^{99}$Tc and retaining the corrosion products (goethite(FeOOH/magnetite), subjecting the said corrosion products to the step of vitrification, and storing the said vitrified $^{99}$Tc bearing waste.

5 Claims, 1 Drawing Sheet

Flow chart of process for $^{99}$Tc sequestration

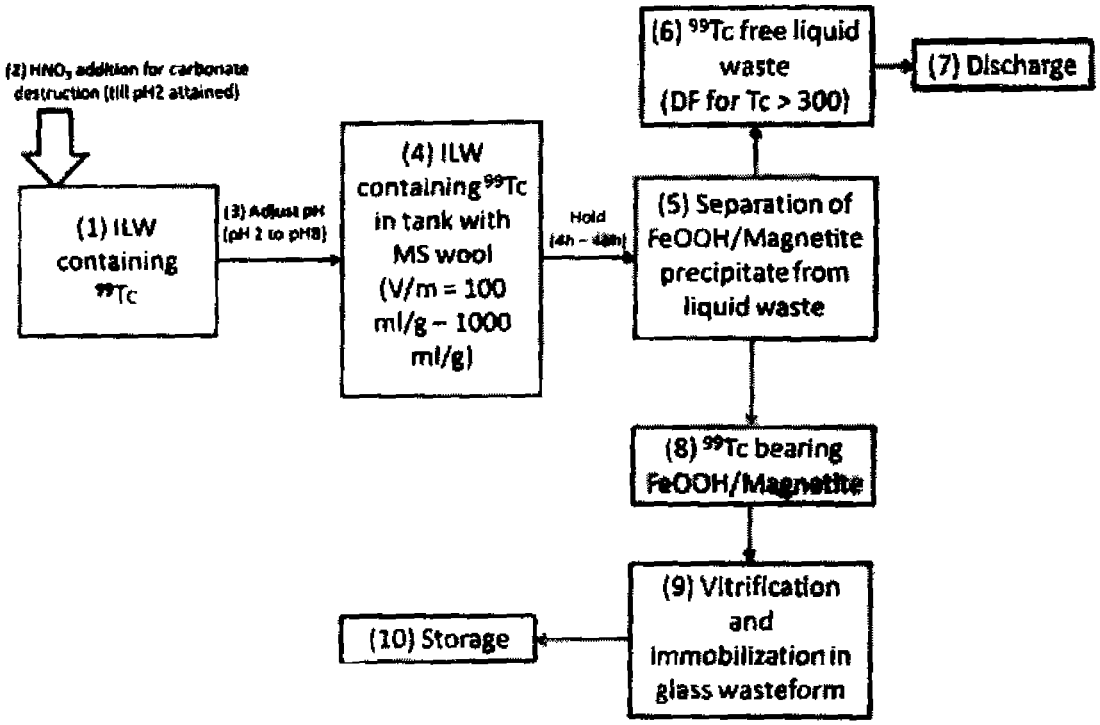
Flow chart of process for $^{99}$Tc sequestration

PROCESS FOR THE REMOVAL OF $^{99}$TC FROM LIQUID INTERMEDIATE LEVEL WASTE OF SPENT FUEL REPROCESSING

CROSS-REFERENCE TO RELATED APPLICATION

This application is the United States national phase of International Application No. PCT/IN2017/050170 filed May 9, 2017, the disclosure of which is hereby incorporated in its entirety by reference.

BACKGROUND OF THE INVENTION $^{99}$Tc arising from spent fuel reprocessing is a major radiation concern owing to a combination of high thermal fission yield (6%), long half life ($2.13\times10^5$ y), high environmental mobility in oxidized pertechnate form combined with radioactivity as a β-emitter. Further, $^{99}$Tc presents a challenge to conventional high temperature vitrification in a borosilicate glass matrix owing to its volatility at glass synthesis temperatures.

One of the methods to capture $^{99}$Tc, is to immobilize it in a suitable matrix like an iron based spinel material such as magnetite ($Fe_3O_4$) or a common corrosion product of iron and steel in aqueous or marine environments such as Goethite (FeOOH). This subject has been investigated using theoretical and experimental means. The salient findings are as follows:

1. Three Tc (IV) can replace four Fe (III) in α-Goethite (FeOOH), while creating one Fe (III) vacancy or replacement of Fe (III) by Fe (II).
2. Fe (II) is essential for reduction of pertechnate ionic species
3. Goethite conversion to magnetite is impeded by the presence of phosphate species in the waste
4. Leach rates of Tc (IV) incorporated into either magnetite/goethite structure are very low
5. Probability of Tc (IV) re-oxidation into Tc (VII) is quite small once Tc (IV) is part of magnetite/goethite crystal structure under heating in air
6. Experiments on $^{99}$Tc removal using α-Goethite (FeOOH) have been reported on lab scale. However, in these processes, ferrihydrite (Precursor to Goethite), is synthesized ex-situ under anoxic conditions and then added to the liquid waste, followed by dosing with Fe (II), usually $FeCl_2$
7. The literature presented and also references therein contain many examples of the use of ex-situ synthesized ferrihydrite used for Tc removal, such as from Tc contaminated soils.
8. The incorporation of Tc into Fe-oxyhydroxides/oxides is well known in the literature, including the references provided and references therein. However, there is no procedure in the literature that allows a simple single step formation of these iron oxides/oxyhydroxides, without the prior ex-situ synthesis of ferrihydrite phase under anoxic conditions.
9. Tc removal using FeS route is also well reported in the literature. In this method, Tc is sequestrated in a sulphur bearing phase such as Mackinawite. However, such a sulphide bearing waste cannot be vitrified in conventional borosilicate wasteforms, which significantly limit the utility of this technique.
10. Elemental iron has also been used for reduction of $Tc^{7+}$ to the less mobile $Tc^{4+}$ form, using nano-iron supported on a variety of high area substrates. In these cases, it has been established using EXAFS that Tc is sorbed on the surface of the isolated nano iron particles as $TcO_6$ octahedra, but they are not taken up into a mineral phase.

Processes extent in the literature discusses the removal and sequestration of $^{99}$Tc by co-precipitation of iron oxides and iron oxy-hydroxides such as magnetite or goethite, however, the synthesis of ferrihydrite, a precursor to goethite, is carried out ex-situ. The reaction of $FeCl_2.4H_2O$ with a pH increasing to near 7.5 using NaOH solution (1 M) yields ferrihydrite, which is unstable in air and is therefore synthesized and also stored in anoxic conditions. Such a storage protocol also implies that any contact of ferrihydrite with oxygen will result in the formation of $Fe(OH)_3$ and associated products, including magnetite. Ex-situ formed crystalline material such as magnetite shows poor Tc uptake and this makes storage and indeed ex-situ preparation a highly involved process, which is an impediment for scale up to plant scale operations.

The other process of FeS assisted precipitation of Tc suffers from the end product being a sulphide, which is then incompatible with borosilicate glass matrices. Consequently, the sulphide wastes are disposed in cement, a waste form having a significantly shorter life than the half life of $^{99}$Tc ($2.13\times10^5$ y). Additionally, there is the attendant risk of Tc remobilization by oxidation from sulphide wasteforms.

The third method extant in the literature is the use of zero valent iron for reductive sequestration of Tc. Indeed, this method has been used for reductive removal of various metals including Cr, Pb and As to name a few from various liquid streams. In reference 11 listed in prior art, it has been proven using Extended X-ray Absorption Fine Structure Spectroscopy (EXAFS) that Tc is reduced from Tc (VII) to Tc(IV) and also Tc (V) by elemental nano iron. Isolated $TcO_6$ octahedra are then adsorbed on the surface of iron nano-particles. In such a state, they are not part of a mineral lattice. Therefore, potential reoxidation and remobilization risk remains viable in such an immobilization strategy.

The proposed process avoids the ex-situ ferrihydrite synthesis steps and the associated anoxic conditions. Instead, goethite/magnetite is generated in-situ by the corrosion of mild steel wool introduced into the intermediate level waste (ILW) with ILW volume to mass of steel ratio (V/m) ranging from 100 $ml\cdot g^{-1}$ to 1000 $ml\cdot g^{-1}$ with pH between 2-8.

Of note is the fact that the sequestered Tc will be accommodated in mineral phases, which may reduce remobilization risks. After a holding time of ~4 h-48 h, more than 99% of the $^{99}$Tc in the ILW is taken up either by goethite or magnetite phases formed as corrosion products. These corrosion products can be directly disposed by vitrification into durable borosilicate wasteforms, since the $^{99}$Tc is fixed in the crystal lattice of the corrosion product and therefore, cannot volatilize or re-oxidize as easily. As an additional benefit, waste volume generation is small. Further, since the quantity of mild steel lost in corrosion is quite small, the mild steel wool can be continuously re-used for in-situ generation of goethite/magnetite.

OBJECTS OF THE INVENTION

An object of the present invention is to propose a process for the removal of $^{99}$Tc from liquid intermediate level waste of spent fuel reprocessing.

Another object of the present invention is to propose a process to capture 99Tc in a form amenable to vitrification in chemically durable borosilicate glass, while minimizing volatilization losses of $^{99}Tc$ during high temperature melting.

Further object of the present invention is to prepare a process where iron oxide/iron oxy-hydroxide phases are synthesized in-situ and there is no further additive of chemical Still further object of the present invention is to propose a process which does not generate secondary waste, while it is also much more economical than other extant process such as ion exchange resin or solvent extraction process.

Yet another object of the present invention is to propose a process wherein the precursors to the phases capture Tc and is not synthesized ex-situ in anoxic conditions.

BRIEF DESCRIPTION OF THE PRESENT INVENTION

According to this invention there is a process for removal of $^{99}Tc$ from liquid intermediate level waste (ILW) of spent fuel reprocessing comprising:

adding $HNO_3$ to ILW till the pH is 2 to destroy the carbonates, transferring the ILW derived of carbonates to a tank containing mild steel wool (msw) for 4 to 48 hrs, subjecting the ILW and MS Wool to the step of separation, discharging the supernatant solution free of $^{99}Tc$ and retaining the corrosion products (goethite(FeOOH/magnetite)

subjecting the said corrosion products to the step of vitrification, and storing the said vitrified $^{99}Tc$ bearing waste.

BRIEF DESCRIPTION OF THE ACCOMPANYING DRAWING

FIG. 1: show the illustrates the basic process flowchart for removal of $^{99}Tc$ from liquid intermediate level waste (ILW).

DETAILED DESCRIPTION OF THE INVENTION $^{99}Tc$ arising from spent fuel reprocessing is a major radiation concern owing to a combination of high thermal fission yield (6%), long half life ($2.13\times10^5$ y), high environmental mobility in oxidized pertechnate form combined with radioactivity as a β-emitter. Further, $^{99}Tc$ presents a challenge to conventional high temperature vitrification in a borosilicate glass matrix owing to its volatility at glass synthesis temperatures.

As a result, efforts are underway to capture and sequestrate $^{99}Tc$ using ion exchange resins (elutable and non-elutable), crown ethers or capture in mineral phases. Indeed, it is known that $^{99}Tc$ can be sequestrated into various mineral phases including perovskites, rutile, sodalite, trevorite, goethite and magnetite to name a few. However, the preparation of most of these phases requires high temperature conditions. Efforts to utilize goethite/magnetite to capture $^{99}Tc$ from Sanford Low Activity Waste (LAW) were carried out on bench scale by co-precipitating goethite in the LAW solutions. While Tc capture using goethite was demonstrated in these studies, the ferrihydrite precursor for goethite formation was synthesized ex-situ under anoxic conditions. Synthesis, and particularly storage, of ferrihydrite is challenging due to its instability and its conversion to $Fe_3O_4$ upon exposure to air oxygen. It has also been demonstrated that ex-situ synthesized $Fe_3O_4$ does not show Tc uptake.

It is clear from literature that mineralization of Tc in Fe-oxides/oxyhydroxides is well known. Indeed, such take-up has been the subject of several papers and reports listed in the prior art (and references therein). Also well known is that mild steel can corrode in aqueous environment to produce iron oxides/oxy-hydroxide phases as corrosion product. In the process developed, we exploit corrosion of mild steel to produce the iron oxide/oxy-hydroxide phases required for Tc sequestration, while avoiding ex-situ synthesis of ferrihydrite under demanding anoxic conditions.

We utilize the corrosion of mild steel (TechSorb®) in acidic aqueous environment of the pH adjusted intermediate level waste (ILW) to generate goethite and/or magnetite in-situ, avoiding the necessity of anoxic conditions for ex-situ synthesis of ferrihydrite, greatly improving process applicability. In order to ensure that adequate quantity of corrosion product is formed, pH in the range 2-8 is required. If carbonate species are present in the ILW, they act as a pH buffer and prevent pH reduction below 9. In the pH range of 9 or greater, steel corrosion by galvanic process is extremely low owing to $OH^-$ neutralization of anodic sites on the steel. Consequently, carbonate destruction by acid addition up to pH 2, may be required if the ILW is carbonate bearing.

At pH 2, mild steel corrosion is extremely rapid, and the release of $Fe^{2+}$ ions from the surface of the corroding steel also generates $OH^-$ in the ILW, consequently raising its pH. In approximately 4-8 hours depending upon the ILW volume to mild steel mass ratio V/m (ranging from 100 $ml\cdot g^{-1}$-1000 $ml\cdot g^{-1}$), adequate goethite/iron oxy-hydroxide phase is formed. Phase formation is significantly accelerated by increasing temperature to 60° C. The number of Tc counts of the liquid waste reduces by over 99%, with the Tc activity being concentrated in the precipitated phase, both settled and also trapped in the mild steel wool. Goethite is able to take up Tc as it precipitates in ILW and there was no significant difference in Tc uptake behavior even with air or nitrogen bubbling through the ILW, indicating that adequate dissolved oxygen is already present in the liquid ILW.

Changing the pH to 4 or 6 maintaining a V/m of 100 $ml\cdot g^{-1}$ slows the process down as $Fe^{2+}$ release from the mild steel wool is slower at less acidic pH. However, 99%+ removal of $^{99}Tc$ was again obtained, but after 48 hours. It was observed that at pH 4 or pH 6, the volume of precipitated goethite is significantly less than in case of pH 2 owing to the less aggressive nature of the ILW at pH4 or pH 6 toward the mild steel wool. The quantity of corrosion product formed was lower still at pH8. However, in all cases, the quantity of goethite formed is sufficient to remove Tc from the ILW stream.

The process is also effective for Tc sequestration from saline/sea water. In such a case also, one of the corrosion products formed is likely to be goethite, which may be instrumental in Tc sequestration. In case of sea water, 95% Tc removal has been demonstrated in approximately two hours.

Tc free liquid can be directly discharged to environment. Additionally, the process also demonstrates substantial pick-up of Ru (~80%) and Sb (>99%). $^{99}Tc$ bearing goethite phase is then collected for immobilization. Since $^{99}Tc$ has entered the crystal lattice of Goethite, it will not be released and/or volatilized during high temperature vitrification operations, allowing $^{99}Tc$ to be incorporated into a durable vitreous wasteform, which will ensure its isolation from the biosphere.

The various steps in the process, as numbered, are described below:

Carbonate destruction in ILW containing $^{99}Tc$ (1) by addition of $HNO_3$ (2) is carried out till pH2 is attained.

This allows complete removal of the carbonate-bicarbonate buffering action, allowing pH to be adjusted in the range 2-8 (3).

ILW is then transferred to a tank containing mild steel wool (4). ILW volume to mild steel mass ratio (V/m) is between 100 $ml \cdot g^{-1}$ and 1000 $ml \cdot g^{-1}$. ILW is then allowed to stand in the tank between 4 h and 48 h, in contact with the mild steel wool.

If the volume of ILW is large, then enhanced mixing and contact between the mild steel wool and the liquid can be ensured through air bubbling In this time, corrosion product of mild steel, goethite (FeOOH) and/or magnetite will precipitate in-situ and take up $^{99}Tc$ into their crystal lattice.

The corrosion products (goethite (FeOOH)/magnetite) are separated from the waste, and the supernatant solution, now free of $^{99}Tc$ (6) can be safely discharged (7).

$^{99}Tc$ bearing goethite (FeOOH)/magnetite (8) can be vitrified and immobilized in a glass wasteform (9). Since $^{99}Tc$ is harbored in goethite (FeOOH)/magnetite phase, volatilization of $^{99}Tc$ during vitrification is minimized.

The vitrified $^{99}Tc$ bearing waste form is then stored securely (10).

Composition range of mild steel wool used is as follows:

| Element | Percentage (%) |
|---|---|
| C | 0.10-0.20 |
| S | 0.02-0.03 |
| P | 0.02-0.03 |
| Mn | 0.2-1.2 |
| Si | 0.02-0.07 |
| Cr | 0.02-0.04 |
| Ni | 0.01-0.02 |
| Mo | 0.01-0.02 |

EXAMPLES

Example 1: Performance of Mild Steel Wool in $^{99}Tc$ Containing Intermediate Level Waste (ILW) at pH 2, V/m=100 $ml \cdot g^{-1}$ $^{99}Tc$ containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.5 g of mild steel wool to obtain V/m of 100 $ml \cdot g^{-1}$. The most significant activity contributor in the ILW was $^{99}Tc$ with total counts of ~25,000 per ml per 100 seconds of ILW.

After 4 hours, the solution pH was measured to be 6.60, while the number of counts in the solution was approximately 86 counts per ml per 100 seconds, which implies a removal of 99.7% of $^{99}Tc$ from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 2: Performance of Mild Steel Wool in $^{99}Tc$ Containing Intermediate Level Waste (ILW) at pH 2, V/m=200 $ml \cdot g^{-1}$ $^{99}Tc$ containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.25 g of mild steel wool to obtain V/m of 200 $ml \cdot g^{-1}$. The most significant activity contributor in the ILW was $^{99}Tc$ with total counts of ~25,000 per ml per 100 seconds of ILW.

After 4 hours, the solution pH was measured to be 6.05, while the number of counts in the solution was approximately 69 counts per ml per 100 seconds, which implies a removal of 99.7% of $^{99}Tc$ from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 3: Performance of Mild Steel Wool in $^{99}Tc$ Containing Intermediate Level Waste (ILW) at pH 2, V/m=500 $ml \cdot g^{-1}$ $^{99}Tc$ containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.1 g of mild steel wool to obtain V/m of 500 $ml \cdot g^{-1}$. The most significant activity contributor in the ILW was $^{99}Tc$ with total counts of ~25,000 per ml per 100 seconds of ILW.

After 4 hours, the solution pH was measured to be 6.05, while the number of counts in the solution was approximately 69 counts per ml per 100 seconds, which implies a removal of 99.7% of $^{99}Tc$ from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 4: Performance of Mild Steel Wool in $^{99}Tc$ Containing Intermediate Level Waste (ILW) at pH 2, V/m=1000 $ml \cdot g^{-1}$ $^{99}Tc$ containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.05 g of mild steel wool to obtain V/m of 1000 $ml \cdot g^{-1}$. The most significant activity contributor in the ILW was $^{99}Tc$ with total counts of ~25,000 per ml per 100 seconds of ILW.

After 24 hours, the solution pH was measured to be 5.69, while the number of counts in the solution was approximately 51 counts per ml per 100 seconds, which implies a removal of 99.8% of $^{99}Tc$ from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 5: Performance of Mild Steel Wool in $^{99}$Tc Containing Intermediate Level Waste (ILW) at pH 2, V/m=100 ml·g$^{-1}$; with Nitrogen Gas Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.5 g of mild steel wool to obtain V/m of 100 ml·g$^{-1}$. Also, nitrogen gas was bubbled through the ILW solution in the conical flask for the duration of the experiment, for agitation mixing and to demonstrate Tc sequestration even under reduced oxygen availability in the ILW solution. The most significant activity contributor in the ILW was $^{99}$Tc with total counts of 25,000 per ml per 100 seconds of ILW.

After 8 hours, the solution pH was measured to be 7.09, while the number of counts in the solution was approximately 77 counts per ml per 100 seconds, which implies a removal of 99.7% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 6: Performance of Mild Steel Wool in $^{99}$Tc Containing Intermediate Level Waste (ILW) at pH 2, V/m=100 ml·g$^{-1}$; with Air Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.5 g of mild steel wool to obtain V/m of 100 ml·g$^{-1}$. Also, air was bubbled through the ILW solution in the conical flask for the duration of the experiment, in order to provide agitation and also increase oxygen availability in the ILW solution. The most significant activity contributor in the ILW was $^{99}$Tc with total counts of ~25,000 per ml per 100 seconds of ILW.

After 4 hours, the solution pH was measured to be 5.97, while the number of counts in the solution was approximately 80 per ml per 100 seconds, which implies a removal of 99.7% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 7: Performance of Mild Steel Wool in $^{99}$Tc Containing Intermediate Level Waste (ILW) at pH 4, V/m=100 ml·g$^{-1}$ $^{99}$Tc containing ILW was treated with $HNO_3$ such that carbonate present in the waste was completely destroyed at pH 2. Solution pH was then adjusted to 4, by addition of $NH_4OH$ solution. After ensuring that solution pH remains stable at 4 for 30 minutes-1 hour, 50 ml of the pH adjusted waste was transferred to a conical flask containing 0.5 g of mild steel wool to obtain V/m of 100 ml·g$^{-1}$. The most significant activity contributor in the ILW was $^{99}$Tc with total counts of ~25,000 per ml per 100 seconds of ILW.

After 48 hours, the solution pH was measured to be 7.93, while the number of counts in the solution was approximately 59 per ml per 100 seconds, which implies a removal of 99.8% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 8: Performance of Mild Steel Wool in $^{99}$Tc Containing Intermediate Level Waste (ILW) at pH 6, V/m=100 ml·g$^{-1}$ $^{99}$Tc containing ILW was treated with $HNO_3$ such that carbonate present in the waste was completely destroyed at pH 2. Solution pH was then adjusted to 6, by addition of $NH_4OH$ solution. After ensuring that solution pH remains stable at 6 for 30 minutes-1 hour, 50 ml of the pH adjusted waste was transferred to a conical flask containing 0.5 g of mild steel wool to obtain V/m of 100 ml·g$^{-1}$. The most significant activity contributor in the ILW was $^{99}$Tc with total counts of 25,000 per ml per 100 seconds of ILW.

After 48 hours, the solution pH was measured to be 7.87, while the number of counts in the solution was approximately 40 per ml per 100 seconds, which implies a removal of 99.8% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 9: Performance of Mild Steel Wool in $^{99}$Tc Containing Intermediate Level Waste (ILW) at pH 8, V/m=100 ml·g$^{-1}$ $^{99}$Tc containing ILW was treated with $HNO_3$ such that carbonate present in the waste was completely destroyed at pH 2. Solution pH was then adjusted to 8, by addition of $NH_4OH$ solution. After ensuring that solution pH remains stable at 6 for 30 minutes-1 hour, 50 ml of the pH adjusted waste was transferred to a conical flask containing 0.5 g of mild steel wool to obtain V/m of 100 ml·g$^{-1}$. The most significant activity contributor in the ILW was $^{99}$Tc with total counts of 25,000 per ml per 100 seconds of ILW.

After 48 hours, the solution pH was measured to be 7.96, while the number of counts in the solution was approximately 97 per ml per 100 seconds, which implies a removal of 99.7% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 10: Performance of Mild Steel Wool in Pure $^{99}$Tc Acidic Solution $^{99}$Tc was picked up from ILW on anion exchange resin, and then eluted using κM $HNO_3$. $NH_4OH$ was then used to adjust solution pH to nearly 8. After ensuring that solution pH remains stable at 6 for 30 minutes-1 hour, 50 ml of the pH adjusted waste was transferred to a conical flask containing 0.5 g of mild steel wool to obtain V/m of 100 ml·g$^{-1}$. The eluted solution exhibited around 1200 counts per ml per 100 seconds.

After 24 hours, the solution pH was 8.1, while the number of counts in the solution was approximately 126 per ml per 100 seconds, which implies a removal of 90% of $^{99}$Tc from the solution. Black corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be $Fe_3O_4$ (magnetite). Pure Tc bearing solution was free of carbonates, which removed the need for carbonate destruction.

Example 11: Performance of Mild Steel Wool in $^{99}$Tc Containing Intermediate Level Waste (ILW) at pH 2, V/m=100 ml·g$^{-1}$, Temperature 60° C. with Air Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.5 g of mild steel wool to obtain V/m of 100 ml·g$^{-1}$. The conical flask was placed in a water bath heated to 60° C. Also, air was bubbled through the ILW solution in the conical flask for the duration of the experiment. The most significant activity contributor in the ILW was $^{99}$Tc with total counts of ~25,000 per ml per 100 seconds of ILW.

After 30 minutes, the solution pH was measured to be 5.57, while the number of counts in the solution was approximately 79 counts per ml per 100 seconds, which implies a removal of 99.7% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 12: Performance of Mild Steel Wool in $^{99}$Tc Containing Intermediate Level Waste (ILW) at pH 2, V/m=200 ml·g$^{-1}$, Temperature 60° C. with Air Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.25 g of mild steel wool to obtain V/m of 200 ml·g$^{-1}$. The conical flask was placed in a water bath heated to 60° C. Also, air was bubbled through the ILW solution in the conical flask for the duration of the experiment. The most significant activity contributor in the ILW was $^{99}$Tc with total counts of ~25,000 per ml per 100 seconds of ILW.

After 1 hour, the solution pH was measured to be 5.82, while the number of counts in the solution was approximately 90 counts per ml per 100 seconds, which implies a removal of 99.6% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 13: Performance of Mild Steel Wool in ° Tc Containing Intermediate Level Waste (ILW) at pH 2, V/m=500 ml·g$^{-1}$, Temperature 60° C. with Air Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.1 g of mild steel wool to obtain V/m of 500 ml·g$^{-1}$. The conical flask was placed in a water bath heated to 60° C. Also, air was bubbled through the ILW solution in the conical flask for the duration of the experiment. The most significant activity contributor in the ILW was $^{99}$Tc with total counts of ~25,000 per ml per 100 seconds of ILW.

After 2 hours, the solution pH was measured to be 5.11, while the number of counts in the solution was approximately 95 counts per ml per 100 seconds, which implies a removal of 99.6% of $^{99}$Tc from the solution. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 14: Performance of Mild Steel Wool in ° Tc Containing Intermediate Level Waste (ILW) at pH 2, V/m=1000 ml·g$^{-1}$, Temperature 60° C. with Air Bubbling $^{99}$Tc containing ILW was treated with $HNO_3$ such that carbonate present in the waste was completely destroyed at pH 2. After ensuring that solution pH remains stable at 2 for 30 minutes-1 hour, 50 ml of the pH adjusted waste was transferred to a conical flask containing 0.05 g of mild steel wool to obtain V/m of 1000 ml·g$^{-1}$. The conical flask was placed in a water bath heated to 60° C. Also, air was bubbled through the ILW solution in the conical flask for the duration of the experiment. The most significant activity contributor in the ILW was $^{99}$Tc with total counts of ~25,000 per ml per 100 seconds of ILW.

After 4 hours, the solution pH was measured to be 4.93, while the number of counts in the solution was approximately 97 counts per ml per 100 seconds, which implies a removal of 99.6% of $^{99}$Tc from the solution. An increase in temperature to 60° C. allows 99.6% Tc removal in 4 hours, while for the same V/m, removal time was nearly 24 h at room temperature. A reddish brown corrosion product is formed, which settles to the bottom and most of the original activity of the ILW is concentrated in this phase, both settled and also adhering to the wool. Since the corrosion product settles to the bottom, separation is quite simple. The colour of the corrosion product indicates that the material formed is most likely to be FeOOH (goethite).

Example 15: Performance of Mild Steel Wool in $^{99}$Tc Containing Sea at pH 2, V/m Varying from 100-1000 ml·g$^{-1}$, with Air Bubbling at Room Temperature $^{99}$Tc containing sea water was adjusted to pH2 by $HNO_3$ addition. After ensuring that solution pH remains stable at 2 for 30 minutes-1 hour, 50 ml of the pH adjusted waste was transferred to conical flasks containing required quantity of mild steel wool to obtain V/m of 100 ml·g$^{-1}$-1000 ml·g$^{-1}$. Air was bubbled through the solutions in the conical flasks for the duration of the experiments. The most significant activity contributor in the sea water was $^{99}$Tc with total counts of 1600 per ml per 100 seconds of ILW.

For all the above experiments, over 95% Tc removal was obtained between 2 h and 20 h, with solution pH after this time ranging from approximately 5 to 7. Reddish brown corrosion product is formed.

Example 16: Studies into Ru and Sb Uptake from Tc Bearing ILW

Samples from experiments above, pre and post Tc removal were analyzed for potential Ru and Sb uptake by γ-spectroscopy. These measurements indicate substantial pick-up of Ru (~80%) and Sb (>99%).

General Statements:

1. Tc removal is faster at higher V/m
2. For a given V/m Tc removal is augmented by increasing temperature (~60° C. in our experiments)
3. The presence of $Cl^-$ and $SO_4^{-2}$ in the liquid is likely to enhance formation of goethite/magnetite as corrosion products, which may result in accelerated Tc pick-up in such environments
4. Presence of carbonate-bicarbonate in waste inhibits formation of corrosion products, thus interfering with Tc uptake
5. The method used above also demonstrates substantial pick-up of Ru (~80%) and Sb (>99%).

We claim:

1. A process for removal of $^{99}$Tc from liquid intermediate level waste (ILW) of spent fuel reprocessing comprising:

adding $HNO_3$ to ILW until the pH is 2, to destroy carbonates;

transferring the ILW deprived of carbonates to a tank containing mild steel wool for 4 to 48 hrs;

subjecting the ILW and mild steel wool to a step of separation to generate a supernatant solution which is free of 99Tc and a corrosion product bearing 99Tc;

discharging the supernatant solution free of 99Tc and retaining the corrosion product;

subjecting the corrosion product to a step of vitrification to produce vitrified 99Tc bearing waste; and storing the vitrified 99Tc bearing waste.

2. The process as claimed in claim 1, wherein a ratio of ILW volume to mild steel wool in the tank is 1:10.

3. The process as claimed in claim 1, further comprising enhancing mixing and contact between the mild steel wool and the liquid through air bubbling.

4. The process as claimed in claim 1, wherein said 99Tc bearing corrosion product is vitrified and immobilized in glass waste form, minimizing volatilization of 99Tc during vitrification.

5. The process as claimed in claim 1, wherein composition of mild steel wool used is as follows:

| Element | Percentage (%) |
|---|---|
| C | 0.10-0.20 |
| S | 0.02-0.03 |
| P | 0.02-0.03 |
| Mn | 0.2-1.2 |
| Si | 0.02-0.07 |
| Cr | 0.02-0.04 |
| Ni | 0.01-0.02 |
| Mo | 0.01-0.02. |

* * * * *